United States Patent [19]

Wahnschaffe et al.

[11] Patent Number: 4,672,923

[45] Date of Patent: Jun. 16, 1987

[54] INTERNAL COMBUSTION ENGINE WITH AT LEAST TWO LIQUID COOLED CYLINDERS

[75] Inventors: Jürgen Wahnschaffe, Bergisch Gladbach; Ernst-Siegfried Hartmann, Rosrath; Karl-Josef Casper; Achim zur Nieden, both of Cologne; Herbert Schleiermacher, Bruehl, all of Fed. Rep. of Germany

[73] Assignee: Kloeckner-Humboldt-Deutz AG, Fed. Rep. of Germany

[21] Appl. No.: 845,607

[22] Filed: Mar. 28, 1986

[30] Foreign Application Priority Data

Apr. 3, 1985 [DE] Fed. Rep. of Germany ..... 3512104

[51] Int. Cl.[4] ..... F01P 3/02

[52] U.S. Cl. ..... 123/41.74; 123/54 R; 123/195 R

[58] Field of Search ..... 123/41.74, 41.79, 193 C, 123/195 R, 54 R

[56] References Cited

U.S. PATENT DOCUMENTS 2,456,951 12/1948 Klotsch ..... 123/41.79
4,194,469 3/1980 Kruger ..... 123/54 R
4,569,313 2/1986 Nobu ..... 123/41.74

FOREIGN PATENT DOCUMENTS 117899 2/1901 Fed. Rep. of Germany .
1220203 6/1966 Fed. Rep. of Germany .
2015948 10/1971 Fed. Rep. of Germany .
57-52654A 3/1982 Japan .
57-124057A 8/1982 Japan .

*Primary Examiner*—William A. Cuchlinski, Jr.
*Attorney, Agent, or Firm*—Charles L. Schwab

[57] ABSTRACT

Each cylinder of a liquid cooled in-line internal combustion engine includes a cylinder pipe surrounded by an annular cooling chamber. The cooling chambers are interconnected in series by crossover passages between adjacent cylinder pipes and the cooling chambers have a greater cross sectional flow area on one side of the longitudinal central plane of the engine than on the other side. This cross sectional flow area relationship is reversed from cylinder to cylinder to thereby cause a meandering course of flow for a portion of the coolant thereby assuring adequate flow around the entire surface of the cylinder pipe and good flushing of the crossover passages between the cylinder pipes.

19 Claims, 2 Drawing Figures

INTERNAL COMBUSTION ENGINE WITH AT LEAST TWO LIQUID COOLED CYLINDERS

TECHNICAL FIELD

This invention relates to an in-line, liquid cooled internal combustion engine with at least two liquid cooled cylinders and particularly to such an engine wherein the cooling chambers surrounding the cylinder pipes are connected in series.

PRIOR ART

West German patent DE-PS No. 117899 describes an internal combustion engine with liquid cooled cylinders in which annular cooling chambers surrounding the cylinder pipes overlap to provide a coolant crossover passage at the longitudinal gap between two adjacent cylinder pipes. The annular cooling chamber is connected with an additional cooling chamber in the cylinder head, where the coolant outlet is also located, by means of an interconnecting passage. The coolant inlet passage is located along the lower end of the cylinder which is the end of the cylinder nearest the crankshaft. A disadvantage of this arrangement is that the coolant does not flow uniformly through the cooling chamber. Thus, partial chambers form within the cooling chamber which are hardly affected by the flow of the coolant.

OBJECTS AND SUMMARY OF THE INVENTION

A basic object of this invention is the improvement of flow of coolant in an internal combustion engine having series coolant flow for cooling at least two juxtaposed cylinders using means which are simple in design in such a way that there is an adequate series flow of the coolant over the outer surfaces of all the cylinder pipes.

In the present invention, the area of cross sectional flow of a cooling chamber is greater on one side of the longitudinal central plane of the engine than on the other and the cooling chamber for the next adjacent cylinder is formed with areas of cross sectional flow which are reversed with respect to the longitudinal central plane. This chamber construction causes a substantial coolant flow between the cylinder pipes and across the longitudinal central plane during its passage from one cylinder to the other. Thus, the coolant flows all around the cylinder pipes, and through the crossover passages therebetween, and uniform cooling is assured.

In the preferred embodiment of the invention, the unequal cross sectional areas of flow at laterally opposite sides of the cylinder pipes are created by displacing the axes of the cooling chambers from the axes of the cylinder pipes. This has the advantage that no additional flow restricting components need to be inserted. However, the area of cross sectional flow could be reduced by means of flow restricting elements. Such flow restricting elements could be either inserted or cast in place.

Coolant flow in the crossover passage or gap between adjacent cylinder pipes is increased by connecting the coolant inlet passage with the part of the cooling chamber having the greatest cross sectional flow area. Increased flow efficiency is achieved by forming the inlet passage so as to incline in the direction of the coolant flow in the cooling chamber. Cooling of the entire surface of the cooling pipe is assured by connecting the coolant inlet passage with the cooling chamber for the pipe between the latter's middle part (in the longitudinal direction of the engine) and the gap between it and the adjacent downstream cylinder pipe.

By providing a coolant inlet passage for each cooling chamber, cold coolant is provided for each cylinder pipe and optimum flushing of the gaps or crossover passages between cylinder pipes is provided.

In some in-line engines incorporating the invention, the coolant inlet passage and the coolant outlet passage may be connected to the cylinders on the opposlte ends of the engine in such a way that they are oblique to the longitudinal central plane of the engine.

BRIEF DESCRIPTION OF THE DRAWINGS

Additional characteristics of the invention are to be found in the description and in the drawings, in which.

DETAILED DESCRIPTION OF THE INVENTION

Figure 1:
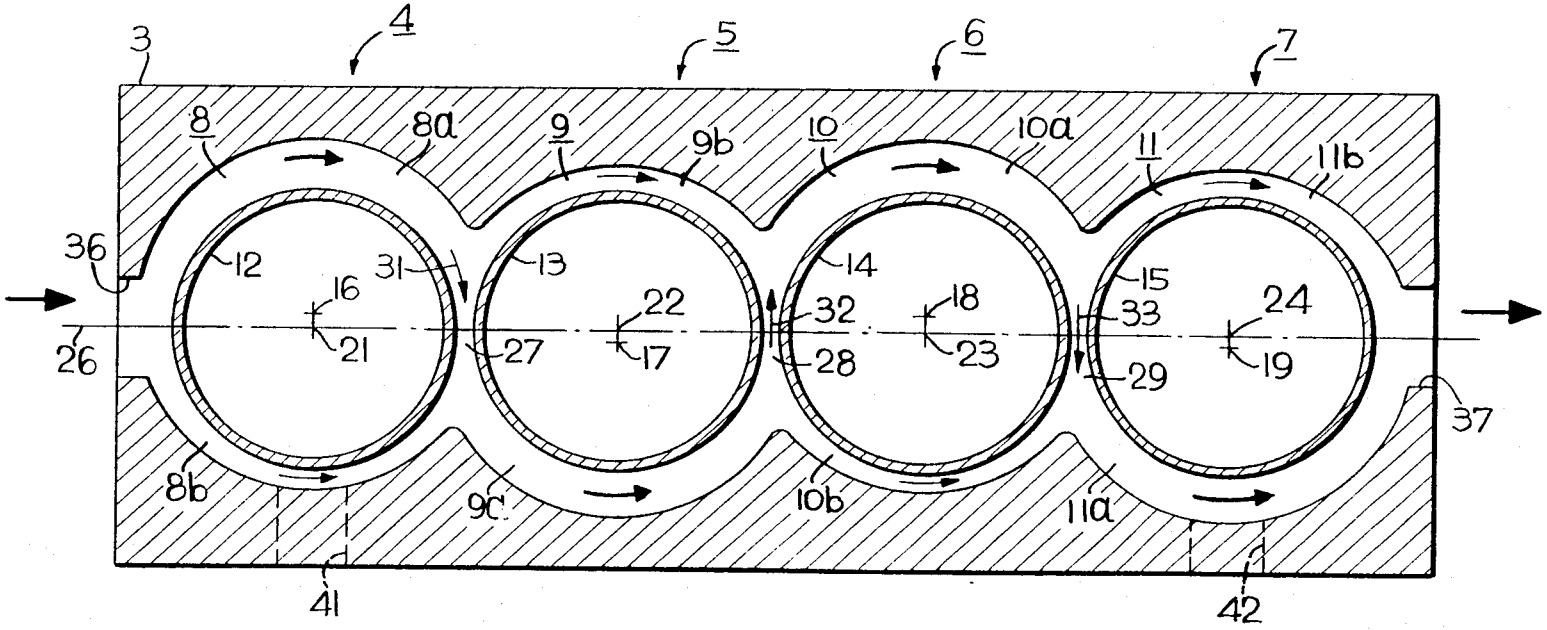
FIG. 1 is a cross-sectional view of juxtaposed cylinders for an in-line internal combustion engine incorporating a first embodiment of the invention.

FIG. 1 schematically illustrates an engine block 3 with a series of four horizontally spaced cylinders 4, 5, 6, 7 of an in-line internal combustion engine. Wall means in the block present surfaces defining annular cylinder-shaped cooling chambers 8, 9, 10, 11 surrounding the cylinder pipes 12, 13, 14, 15 of the cylinders 4–7. The centers or axes 16, 17, 18, 19 of the cooling chambers 8–11 are displaced from the centers or axes 21, 22, 23, 24 of cylinder pipes 12–15 whereby two adjacent cooling chambers are displaced in opposite directions perpendicular to the longitudinal central plane 26 passing through the axes 21–24 of the series of cylinders 4–7. By laterally offsetting the axes 16–19 of the cooling chambers from the axes 21–24 of the cylinder pipes 12–15, the parts of the cooling chambers at opposite lateral sides of the pipes 12–15 are different in size. More specifically, parts 8*a*, 9*a*, 10*a* and 11*a* of cooling chambers 8–11 each have a greater cross sectional flow area for the coolant than do the narrower parts 8*b*, 9*b*, 10*b* and 11*b* of the cooling chambers 8–11. The wider, greater flow parts 8*a*, 9*a*, 10*a*, 11*a* are alternately on opposite sides of the central plane 26 as too are the lesser flow parts 8*b*, 9*b*, 10*b*, 11*b* of the cooling chambers 8–11. This alternating of cross sectional flow areas causes flow in the gaps or crossover passages 27, 28, 29 between adjacent cylinders. The crossover flow of the coolant is indicated by arrows 31, 32, 33.

A coolant inlet passage 36 is located in one longitudinal or front end of the engine block 3 and connects to the cooling chamber 8 at the midpoint of the height of the cylinder pipe 12 of the front end cylinder 4. A coolant outlet passage 37 is connected to chamber 11 of the rear end cylinder 7 at the same height.

In some engines, it may be desirable to provide a coolant inlet passage 41 and an outlet passage 42, as illustrated in FIG. 1, in the block 3 to connect, respectively, to end cooling chambers 8 and 11. These passages 41, 42 are inclined or oblique to the longitudinal central plane 26.

Because of the displacement of the axes 16–19 of cooling chambers 8–11 from the central plane 26 and the resulting differing cross sectional flow areas for the coolant on the opposite sides of longitudinal central plane 26, a meandering course of flow around cylinder pipes 12–15 is produced for a portion of the coolant. Thus, the entire exterior surface of each cylinder pipe is uniformly cooled.

The introduction of obstacles or restricting elements into the cooling chambers can also be used to reduce the cross sectional area of flow without displacing the axes of the cooling chambers from the axes of the cylinder pipes.

Figure 2:
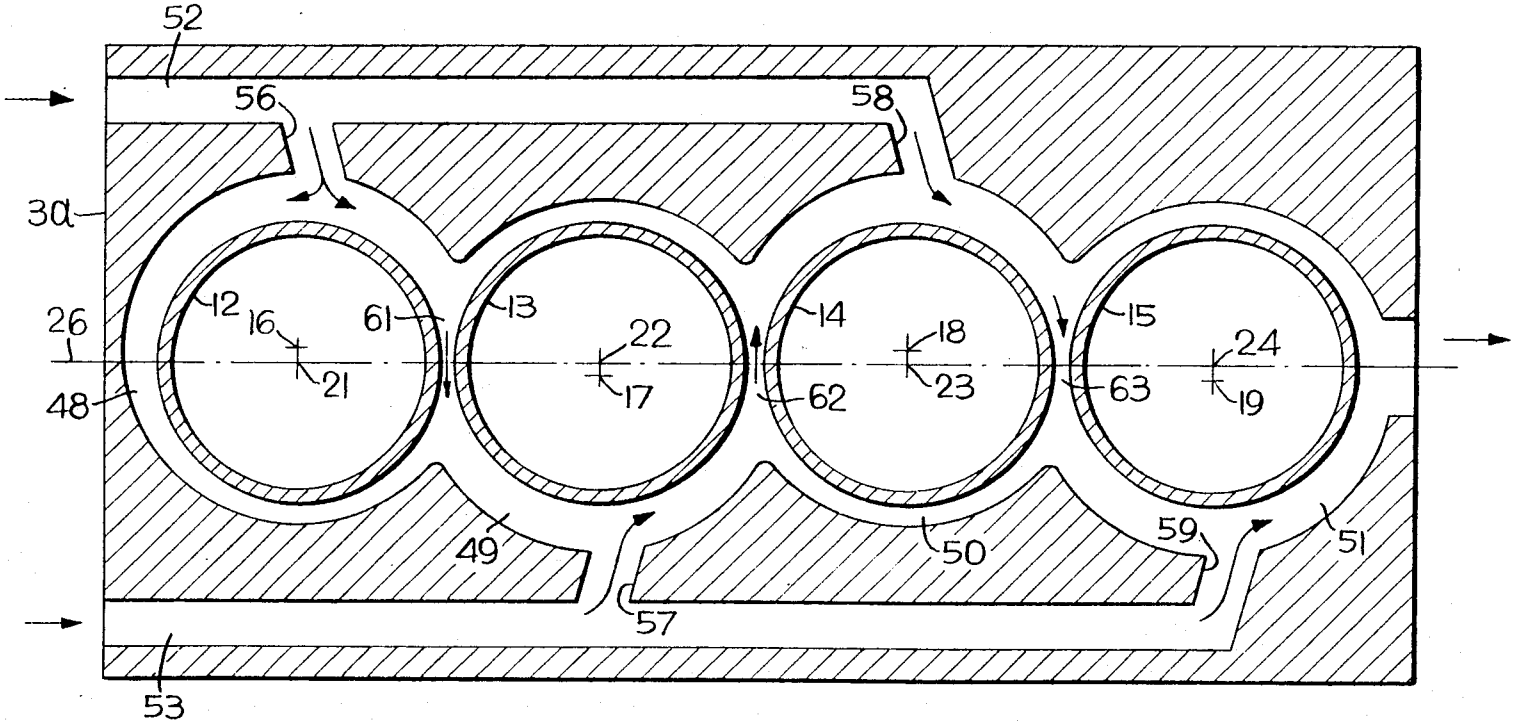
FIG. 2 is a cross-sectional view of juxtaposed cylinders for an in-line internal combustion engine incorporating a second embodiment of the invention.

FIG. 2 illustrates a second embodiment of the invention incorporated in an in-line, four cylinder internal combustion engine. The cooling chambers 48, 49, 50, 51 are formed in the block 3*a* on axes displaced from the axes of the cylinder pipes 12–15 and, thus, are similar to the cooling chambers 8–11 of the embodiment of the invention illustrated in FIG. 1. However, in this second embodiment of the invention, two inlet conduits 52, 53 supply coolant to inlet passages 56, 57, 58, 59 provided, respectively, for the cooling chambers 48–51.

Each cooling chamber 48–51 has its own coolant inlet passage which discharges in the middle of the part of the cooling chamber having the greatest cross sectional area and, hence, having the greatest coolant flow. As illustrated, the inlet passages 56–59 connect to the downstream side of the longitudinal midpoint of the cooling chambers. The inlet passages 56–59 incline in the direction of the coolant flow in the cooling chambers 48–51 to which they connect. Since each of the cooling chambers 48–51 has a coolant inlet passage, fresh coolant, which is at a uniform cold temperature, is routed to each cylinder. The inclination of inlet passages 56–59 in the direction of the coolant flow improves the flushing of the gaps or crossover passages 61, 62, 63 between adjacent cylinder pipes.

OPERATION

In FIG. 1, the coolant flows through coolant inlet passage 36 into cooling chamber 8 of cylinder 4. The flow of coolant is subsequently divided into two partial flows by cooling chamber parts 8*a* and 8*b*. Since the area of cross sectional flow of cooling chamber 8*a* is greater than that of 8*b*, a greater amount of coolant flows through it. In the gap 27, both partial flows are reunited. In the adjacent cylinder 5, the cooling chamber part 9*a*, with the greater cross sectional area, is located on the opposite side of the longitudinal central plane 26 as compared to large flow chamber part 8*a* of cylinder 4. This alternating of the large flow parts of the cooling chambers on opposite lateral sides of the cylinder pipes causes a large flow of coolant across the longitudinal central plane 26 and this provides good coolant flow over the entire cylinder pipe surface, particularly through the crossover gap or passage 27. After the coolant has flowed through the series connected cooling chambers of all the cylinders, it leaves the cylinder block 3 via the coolant outlet passage 37.

In FIG. 2, each of the cooling chambers 48–51 has its own coolant inlet passage, thus providing effective uniform cooling of the cylinder pipes 12–15. The flow of the coolant is further improved by the inclination of inlet passages 56–59 in the direction of the coolant flow and connection of such inlet passages to the greater cross section area part of the cooling chambers 48–51.

The embodiments of the invention in which as exclusive property or privilege is claimed are defined as follows:

1. An internal combustion engine with an engine block having at least two adjacent liquid cooled cylinders spaced from one another in the direction of the longitudinal central plane of the engine, each cylinder having a cylinder pipe surrounded by an annular cooling chamber, the cooling chamber of one of the cylinders being connected to the cooling chamber of the other cylinder by way of a coolant crossover passage between said cylinder pipes, a coolant inlet passage connected to one of said chambers, a coolant outlet passage connected to the other of said chambers, the cross sectional flow area of one cooling chamber being greater on one lateral side of said engine block than on the other lateral side thereof, and the cross sectional flow area of the other cooling chamber being less on said one lateral side of said engine block than on said other lateral side thereof.

2. The internal combustion engine of claim 1 characterized by the fact that the smaller cross sectional flow areas are created by obstacles in the cooling chambers.

3. The internal combustion engine of claim 1 wherein the differences in cross sectional flow areas are caused by displacing the center of the cooling chamber from the center of the associated cylinder pipe.

4. The internal combustion engine of claim 3 wherein said coolant inlet passage connects to said one cooling chamber on one side of said longitudinal central plane.

5. The internal combustion engine of claim 4 wherein said coolant inlet passage inclines in the direction of coolant flow within said one cooling chamber.

6. The internal combustion engine of claim 5 wherein said coolant inlet passage connects to said one cooling chamber between said crossover passage and the midpoint of that part of said one cooling chamber disposed on said one side of said central plane.

7. The internal combustion engine of claim 6 wherein a coolant inlet passage is connected to the larger cross sectional flow area of each cooling chamber.

8. The internal combustion engine of claim 1 wherein said coolant inlet passage connects to said one cooling chamber on said one side of said longitudinal central plane.

9. The internal combustion engine of claim 8 wherein said coolant inlet passage inclines in the direction of the coolant flow within said one cooling chamber.

10. The internal combustion engine of claim 9 wherein said coolant inlet passage connects to said one cooling chamber between said crossover passage and the midpoint of that part of said one cooling chamber disposed on said one side of said central plane.

11. The internal combustion engine of claim 1 wherein a coolant inlet passage is connected to each cooling chamber.

12. The internal combustion engine of claim 11 wherein said coolant inlet passages are connected to the portions of said cooling chambers having the greatest cross sectional flow area.

13. The internal combustion engine of claim 12 wherein said coolant inlet passages are each inclined in the direction of flow of the coolant in that part of the cooling chamber to which attached.

14. The internal combustion engine of claim 12 wherein said coolant inlet passages are connected to said cooling chambers on the downstream side of the longitudinal midpoint thereof.

15. The internal combustion engine of claim 14 wherein said coolant inlet passages are each inclined in the direction of coolant flow in that part of the cooling chamber to which attached.

16. The internal combustion engine of claim 1 wherein said coolant inlet passage and said outlet passage are located at longitudinal opposite ends, respectively, of said engine block and are intersected by said central plane.

17. The internal combustion engine of claim 1 wherein said inlet and outlet passages are oblique to the said central plane.

18. An internal combustion engine comprising:

an engine block having at least two liquid cooled cylinder pipes in side-by-side relation in the longitudinal direction of the engine, wall means in said block presenting surfaces defining a pair of annular liquid cooling chambers surrounding said pipes, said pipes being spaced from one another to define a crossover passage therebetween interconnecting the parts of said chambers disposed on laterally opposite sides of said cylinders, an inlet passage connected in coolant delivering relation to one of said annular chambers, an outlet passage connected in coolant discharging relation to the other of said annular chambers, the part of said chamber for said one pipe disposed on one lateral side of said engine block having a coolant flow cross sectional area greater than the coolant flow cross sectional area of the part of said chamber for said one pipe disposed on the opposite lateral side of said engine block and the part of said chamber for said other pipe disposed on said one lateral side of said engine block having a coolant flow cross sectional area less than the coolant flow cross sectional area of the part of said chamber for said other pipe disposed on said other lateral side of said engine block.

19. The internal combustion engine of claim 18 wherein the unequal cross sectional flow areas of said chambers are created by displacing the axes of said cooling chambers from the axes of said cylinder pipes.

* * * * *